US006874569B2

(12) United States Patent
Gawthrop et al.

(10) Patent No.: US 6,874,569 B2
(45) Date of Patent: Apr. 5, 2005

(54) DOWNFLOW CONDENSER

(75) Inventors: Peter R. Gawthrop, Royal Oak, MI (US); William Melnyk, Lathrup Village, MI (US); Jan Xu, Westland, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 115 days.

(21) Appl. No.: 09/753,298

(22) Filed: Dec. 29, 2000

(65) Prior Publication Data

US 2002/0084063 A1 Jul. 4, 2002

(51) Int. Cl.[7] ..... F28D 1/06; F28F 9/22

(52) U.S. Cl. ..... 165/110; 165/132; 165/174; 62/509

(58) Field of Search ..... 165/110, 132, 165/174; 62/509

(56) References Cited

U.S. PATENT DOCUMENTS

| | | | | | |
|---|---|---|---|---|---|
| 2,004,390 | A | * | 6/1935 | Benzinger | 165/110 |
| 4,141,409 | A | * | 2/1979 | Woodhull et al. | 165/110 |
| 4,877,083 | A | | 10/1989 | Saperstein | 165/176 |
| 4,972,683 | A | | 11/1990 | Beatenbough | 62/507 |
| 5,159,821 | A | | 11/1992 | Nakamura | 62/509 |
| 5,186,249 | A | * | 2/1993 | Bhatti et al. | 165/174 |
| 5,205,351 | A | | 4/1993 | Muller et al. | 165/110 |
| 5,224,358 | A | | 7/1993 | Yamanaka et al. | 62/509 |
| 5,228,315 | A | | 7/1993 | Nagasaka et al. | 62/509 |
| 5,245,842 | A | | 9/1993 | Searfoss et al. | 62/474 |
| 5,375,327 | A | | 12/1994 | Searfoss et al. | 29/890.06 |
| 5,398,523 | A | | 3/1995 | Yoshii et al. | 62/474 |
| 5,537,839 | A | | 7/1996 | Burk et al. | 62/474 |
| 5,546,761 | A | | 8/1996 | Matsuo et al. | 62/509 |
| 5,582,027 | A | | 12/1996 | Baba et al. | 62/509 |
| 5,592,830 | A | | 1/1997 | Baba et al. | 62/509 |
| 5,709,106 | A | | 1/1998 | Inaba et al. | 62/507 |
| 5,752,566 | A | | 5/1998 | Liu et al. | 165/110 |
| 5,755,113 | A | | 5/1998 | Ferguson et al. | 62/474 |
| 5,787,573 | A | | 8/1998 | Pytel et al. | 29/890.06 |
| 5,988,267 | A | | 11/1999 | Park et al. | 165/110 |

* cited by examiner

*Primary Examiner*—Leonard R. Leo
(74) *Attorney, Agent, or Firm*—Brinks Hofer Gilson & Lione

(57) ABSTRACT

Higher heat-exchange capacity and greater vapor-liquid throughflows are attained in a downflow condenser. The increased capacity is achieved by a new design in the manifold to encourage condensation and lessen entrainment of gas phase matter in subcooling flows of condensed liquid. The increased capacity is also achieved by tailoring the flowpaths for a two-phase mixture to avoid reduce liquid film buildup on tubewalls.

4 Claims, 4 Drawing Sheets

DOWNFLOW CONDENSER

BACKGROUND OF THE INVENTION

Refrigeration systems, particularly refrigeration systems in mobile or locomotive applications, are highly restricted in terms of the space available to them. Nevertheless, buyers of such systems demand high performance, and they particularly demand this performance under the most trying conditions. An example may be an automobile air-conditioning system on a hot day in slow traffic. There may be only a small temperature difference between the heat rejected and the sink into which the heat is rejected. The demand on the system, however, or the quantity of heat rejected, may be very great if the automobile has several passengers. In slow traffic with a small amount of ram air, the cooling air heat exchange medium is at a triple disadvantage: the air itself will be at a higher temperature; at slow speeds, the air volume impinging on the heat exchanger will be minimal; and less air mass is available because air is less dense at higher temperatures.

Other examples of mobile applications may include refrigeration systems for truck cabs, over-the-highway refrigerated trailers, refrigerated railcars, passenger trains, and aircraft passenger sections. While these examples suggest locomotive or mobile applications, space may also be at a premium in stationary applications, such as any refrigeration system. These may include, but are not limited to, building air-conditioning systems, smaller air-conditioning or chilling systems, process chillers such as those used on machine tools, refrigeration equipment, compressors, and in short, any application that requires heat transfer. Space is ever at a premium for mechanical equipment or systems, and any heat exchanger or condenser that can be made smaller or more efficient is welcome.

Focusing on the automotive applications, and particularly on the refrigeration system used for air-conditioning, engineers have found that extra space under the hood is very scarce. There is an additional problem, in that space is not the only consideration, but low cost and low weight is also necessary. Any air-conditioning or refrigeration system used in millions of automobiles must be economical. Therefore, many heat exchangers or radiators used in automotive applications tend to have cross-flow arrangements, that is, the coolant tends to flow from left to right, rather than up and down. Cross-flow under the hood allows a longer flow path, creating more surface area for heat exchange, and allowing for a smaller number of tubes in a typical air-cooled radiator.

There are efficiency problems in using a cross-flow heat exchanger in these applications. The most obvious problem may arise in considering the physical changes to the refrigerant in the heat exchange process. In a typical refrigeration system, the condenser receives gaseous refrigerant which has picked up heat that is absorbed from the cooled area or system and compressor. Refrigerants are cooled into a liquid state when they pass through the condenser. However, once the refrigerant or coolant has condensed, it will reside in the bottom half of a heat exchange channel or tube into which it was introduced. Liquid coolant in the bottom of a tube or channel will provide a barrier to the heat path: the heat must now travel from the gaseous refrigerant, through the liquid at the bottom of the tube or channel, and only then through the thickness of the tube or channel, before it can be rejected into cooling air, ram air, or other heat rejection medium.

Even if the heat exchanger uses a multi-pass flow, each pass will see some condensation, and the efficiency of each pass will be degraded at least to the extent and depth of the liquid condensate. What is needed is a heat exchanger that is not "fouled" by liquid condensate. What is needed is a condenser that does not permit such a barrier to accumulate and block heat flow. What is needed is a condenser that quickly and efficiently separates gaseous refrigerant from its condensed liquid, allowing for better efficiency in the condenser and higher heat exchange capacity for the refrigeration system of which it is a part.

BRIEF SUMMARY OF THE INVENTION

The present invention solves this problem by using a downflow condenser, that is, a condenser in which the flow is vertical, rather than left-to-right or cross-flow. In a downflow configuration, gaseous refrigerant enters a top header of the condenser and travels in a vertical path, assisted by gravity, through one or more heat-exchange tubes. The outside of the tubes are typically cooled by air, such as ram air or air from a fan or air provided by movement of the condenser through a medium of cool, gaseous air. Refrigerant condenses on the walls of the tube or tubes and flows downward, rather than accumulating in the sides of the tube or tubes.

In a two-pass downflow condenser, when the refrigerant reaches the bottom header, it accumulates on the first side of a bypass baffle (first pass) which allows only liquid to enter the second side of the bypass baffle (second pass). The liquid refrigerant, comprising much greater mass flow per unit volume than the gaseous refrigerant, then travels upward through the second pass, sub-cooling as it travels, and exiting through the top header. In this arrangement, the first pass condenses the refrigerant and its internal tube surface area has only a thin film of liquid condensate, since liquid condensate flows immediately to the bottom header. The second pass flows only liquid refrigerant, and since the flow is upward, the tubes are full of liquid rather than gas. This allows for the maximum subcooling heat transfer in the second pass, since there will be a full-volume liquid path for conductive transfer through the liquid to the walls of the second-pass tube or tubes. The first pass cools the refrigerant to its boiling point and below, while the second pass sub-cools the refrigerant, that is, the second pass cools the refrigerant further below its boiling point.

One embodiment of the invention is a downflow condenser having an upper horizontal manifold. The manifold has a near end and a far end, separated by a baffle that allows no flow between the near end and the far end. The upper manifold is connected at its near end to at least one first heat-exchange tube, which tube has a first end and second end. The heat exchange tube is connected at its first end to the upper manifold, and is connected at its second end to a lower horizontal manifold. The lower manifold also has near end and a far end, the near end and far end separated by a bypass baffle which allows only liquid to flow from the near end to the far end. The near end of the upper manifold is physically located above the first heat-exchange tube, and the near end of the lower manifold is physically located below the first heat-exchange tube. That is, there is a vertical relationship between the upper manifold, the first heat-exchange tube, and the lower manifold. The near end of the upper manifold, the at least one first heat-exchange tube, and the near end of the lower manifold form a first pass of a heat exchanger or a condenser. Since this arrangement allows for vertical, downward flow of the refrigerant, it is a downflow condenser.

The bypass baffle in the lower manifold passes only liquid to the far end of the lower manifold. The lower manifold has at least one second heatexchange tube connected to the far end of the lower manifold. The second heat-exchange tube has a first end connected to the far end of the lower manifold, and a second end connected to the far end of the upper manifold. The upper manifold is physically above the at least one second tube, which is physically above the lower manifold. The far end of the lower manifold, the at least one second tube, and the far end of the upper manifold form the second pass of a two-pass downflow condenser. Liquid refrigerant flows through the bypass baffle into the far end of the lower manifold, up through the at least one second heat-exchange tube, and into and out of the far end of the upper manifold.

DETAILED DESCRIPTION OF THE INVENTION

Figure 1:
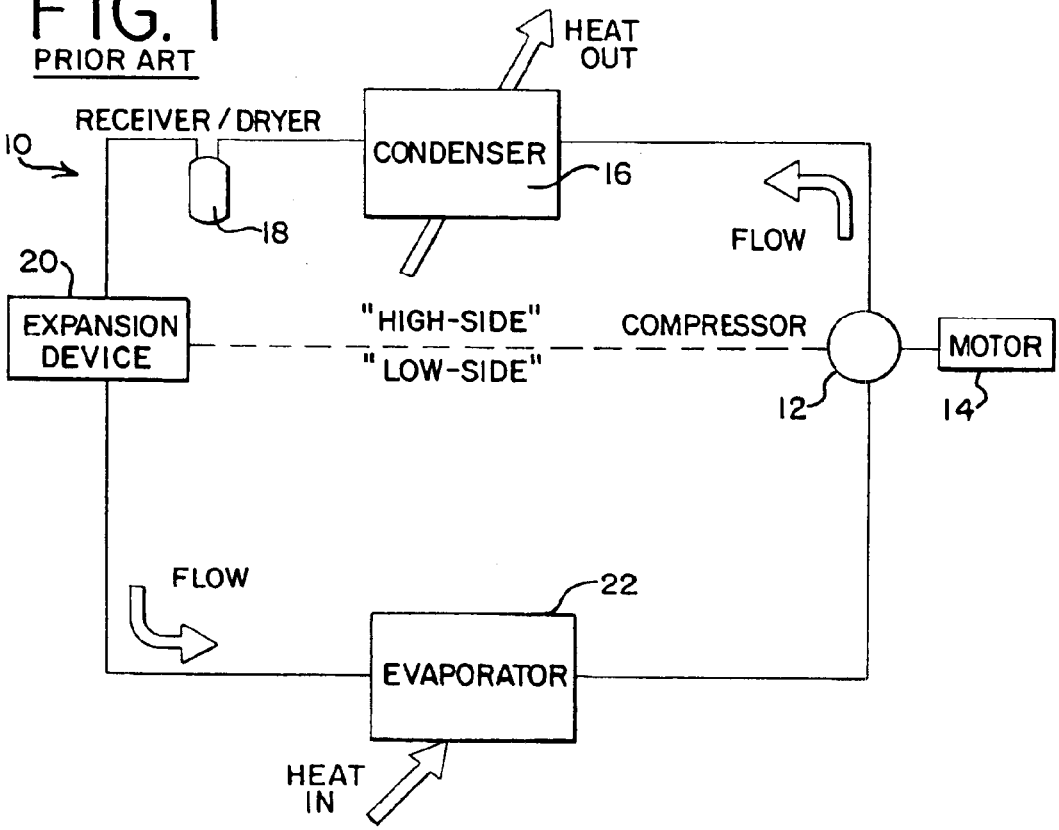
FIG. 1 PRIOR ART
FIG. 1 is a block diagram of a refrigeration system made of components and utilizing a refrigerant.

FIG. 1 illustrates a typical air-conditioning refrigeration system 10. A compressor 12, normally powered by a motor 14 or other power source, compresses refrigerant to a high pressure. The compressed gas flows into a condenser 16 which extracts heat from the gas and rejects the heat into a sink, such as the environment (not shown). The condenser also condenses the compressed gas into a liquid, still at some high pressure. The liquefied refrigerant then is typically dried in a dryer/receiver 18 to remove moisture. The compressor, condenser and dryer are all on what is known as the "high side" of a refrigeration system, since the refrigerant is at high pressure. In use, the refrigerant passes through an expansion device 20, such as a thermal expansion valve (TXV) or an orifice tube, as the refrigerant flows to an evaporator 22. As the liquid expands into a gas, it cools and is now capable of absorbing heat from evaporator 22. The evaporator may have passenger air (not shown) on its far side, the air cooled by the evaporator and sent to automobile passengers (not shown). The refrigerant, having absorbed heat from the evaporator, now travels to the suction side of the compressor 12, and the cycle is repeated. The far side of the expansion device, the evaporator, and the suction side of the compressor are known as the "low-side" of a refrigeration system, since the refrigerant is under lower pressure than the "high-side."

Figure 2:
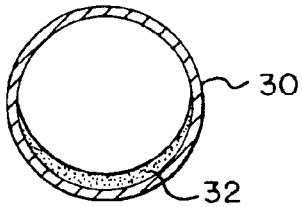
FIG. 2 is a cross-section of a cross-flow tube fouled by condensate.

In a typical cross-flow condenser, hot, pressurized refrigerant gas enters tubes in the condenser and is cooled by air flowing on the outside of the tubes. As the refrigerant cools, it condenses and may pool in the bottom of the tubes, as shown in FIG. 2. Tube 30 is fouled by refrigerant condensate 32 that falls to the bottom of the tube. If the condensate is further contaminated with water, other compounds may eventually form and degrade the performance of the condenser over time.

Figure 3A:
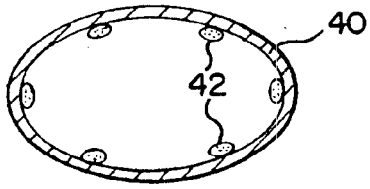
FIGS. 3*a* and 3*b* are cross-sections of a downflow tube.
Figure 3B:
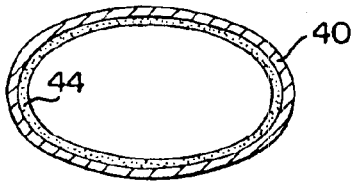

By contrast, in a downflow condenser, when the refrigerant condenses, it forms a film on the inside of the tube or tubes, and flows vertically downward. FIG. 3*a* depicts the cross section of an upper portion of a first tube 40 in the first pass of a downflow condenser, with drops 42 of condensate forming on the inner walls of the tube. FIG. 3*b* depicts the coalescence of the drops or droplets, forming a thin film 44 on the inner surface of the tube 40.

Figure 4:
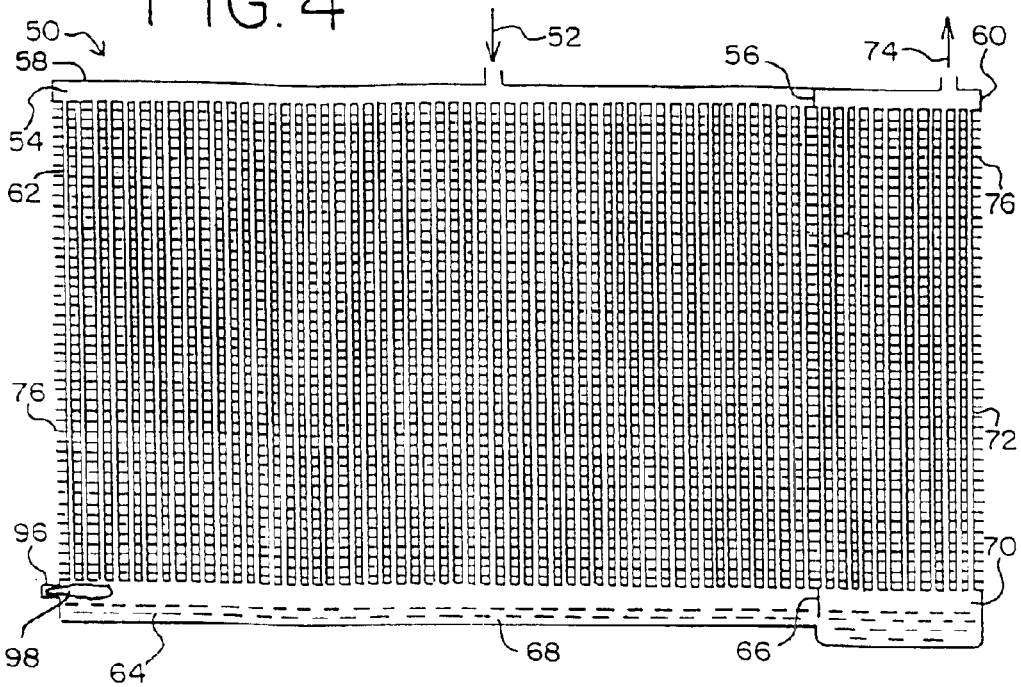
FIG. 4 is a side view of a two-pass downflow condenser with a partial cross-section of a bypass baffle.

FIG. 4 depicts a downflow condenser 50. This particular embodiment is a two-pass condenser. Hot, compressed refrigerant enters the condenser 50 through an inlet 52 at the top of the condenser. Inlet 52 is part of an upper manifold 54, which is divided by baffle 56 into a near portion 58 and a far portion 60. The baffle is impermeable and allows essentially no flow of refrigerant from the near end to the far end through the baffle, consistent with good welding, brazing or joining processes used in manufacturing. At least one first heat exchange tube 62 is connected from the near end of the upper manifold to a lower manifold 64. One or more heat exchange tubes may be used to channel the flow of refrigerant from the upper manifold to the lower. Lower manifold 64 is divided by lower bypass baffle 66 into a near portion 68 and a far portion 70. The bypass baffle is sized and placed so that only liquid flows from the near side of the baffle to the far side. While the upper baffle allowed no flow from near side to far side, the lower bypass baffle must pass liquid refrigerant from the near side to the far side. The placement of the lower baffle and its dimensions are important to the proper operation of the condenser, because the condenser will not function optimally unless gas is restricted to the near side and liquid is quickly routed to the far side of the bypass baffle. On the far side of the bypass baffle, at least one second heat-exchange tube 72 is connected between the far portion 70 of lower manifold 64 and the far portion 60 of upper manifold 54. One or more than one second tube 72 is used. Liquefied refrigerant passes through the bypass baffle 66 into the far portion 70 of the lower manifold 64, up through the at least one second heat-exchange tube 72, into the far portion 60 of the upper manifold 54, and out through an outlet 74. Fins 76 may be used on both the first tubes and the second tubes of the downflow condenser. A liquid level typical in use is depicted in the figure. Also shown in FIG. 4 is port 96 for an integral dryer useful in a downflow condenser.

In this two pass condenser, the first pass constitutes the near portions of the upper and lower manifolds and the first heat exchange tube or tubes. The first pass condenses hot, pressurized gas into a liquid. As it liquefies, the gas gives up its latent heat of vaporization, which is absorbed by the cooling medium on the outside of the first tube or tubes. The second pass constitutes the far ends of the manifolds and the second heat exchange tube or tubes. The second pass subcools the liquefied refrigerant, that is, further cools the refrigerant below its boiling point once it has condensed. Of course, all thermodynamic data, physical properties including boiling points and heats of vaporization and of liquefaction, and so on, are dependent on the environment, such as the pressure of the system in which the refrigerant is used.

In some embodiments using refrigeration systems, evaporator loads are sufficiently high that the refrigerant entering the condenser is superheated, that is, the refrigerant temperature may be well above its boiling temperature at the pressure at which it enters the condenser. Thus, the first pass cools the refrigerant from its superheated state to a temperature at which condensation is possible, and then condenses the refrigerant. Once the refrigerant is cooled below its boiling point at the pressure existing in the condenser, the second pass will sub-cool the refrigerant further below its boiling point. The refrigerant, once liquefied, passes upward through the second stage while continuing to be cooled by one or more second heat exchange tubes. Ultimately, this subcooling will enable the refrigerant to absorb more heat from the evaporator as the refrigerant makes its way past the expansion valve and to the evaporator.

FIG. 4 also depicts the vertical relationships between the manifolds and the tubes, as discussed above, depicting the condenser design so that gravity will influence the flow of refrigerant, downward on the first pass side, for both gaseous and liquid condensate. On the second pass side, liquid flows from bottom to top. In a vertical configuration, the tubes are constrained to fill with fluid before fully effective fluid flow will result. Thus, with full tubes, better conductive heat exchange is achieved, and better sub-cooling is effected. This will allow the refrigerant to pass through the TXV downstream at a lower temperature, and ultimately enable the refrigerant to absorb more heat in the evaporator. This is ultimately the test of the refrigerant system.

Figure 5:
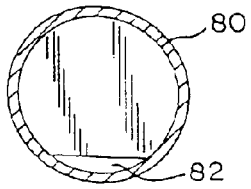
FIG. 5 is a cross section of a bypass baffle.

FIG. 5 is a cross section of a bypass baffle 80 used in the downflow condenser. The baffle covers most of the cross-section of the lower manifold, and only allows a liquid refrigerant to pass from the near end to the far end, through a leak path 82 at the bottom of the baffle. The geometry of the bypass baffle cannot be simply stated, because the flow of liquid in the condenser will vary significantly with the load on the refrigeration system. Rather, the design of the baffle and its size are determined by first determining minimum and maximum refrigerant flow. A worst case may be when refrigerant head pressure is high and flow is low. Under these conditions, little liquid is generated in the first pass, but a high head pressure may tend to force fluid and perhaps gas across the lower bypass baffle. The size of the bypass must be small enough to prevent the flow of gaseous refrigerant across the bypass manifold under these conditions. The opposite case, of course, occurs at high flow, when it is desired to flow a great amount of liquid, but the head pressure is low, thus lowering the motive force for moving refrigerant across the (high resistance) bypass baffle.

Figure 6:
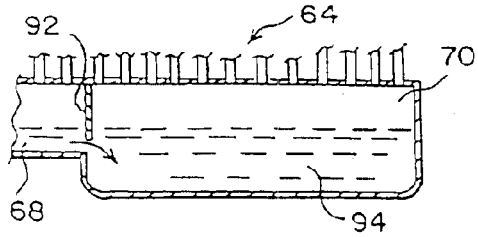
FIG. 6 is a cross section of an alternative baffle.
Figure 7:
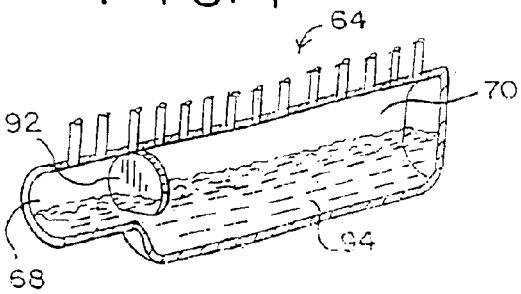
FIG. 7 is an isometric view of the alternative type of baffle.

In addition to a bypass baffle as described above, a baffle of a different type may be constructed by depressing the bottom manifold so that liquid may pass from the near section of the bottom manifold to the far section. FIGS. 6 and 7 depict such an alternative arrangement, where lower manifold 64 has a straight, near section 68 and a far section 70, separated by baffle 92. The baffle has essentially a full cross-section of the near portion of the manifold. The far portion of the lower manifold then has roughly a full cross section of the lower manifold and a depressed area 94, the baffle placement allowing condensed, liquid refrigerant to pass under the baffle 92 and into the far section 70 of the lower manifold.

With either a bypass baffle or a depressed area, the downflow condenser fluid flow works the same way. Gaseous refrigerant is condensed into a liquid state in the first pass, before the liquid refrigerant flows into the second, sub-cooling pass, in a two-pass downflow condenser. The liquid coolant now flows upwards in the second pass, receiving the benefit of further cooling from the condenser as the liquid exchanges more heat with cooling air in the second pass. The liquid refrigerant then flows through the far portion of the upper manifold, and out through the outlet of the condenser. It will be obvious to those skilled in the art that the first pass of such a condenser will require far more tubes for the gaseous refrigerant than the second pass, which passes only liquid refrigerant, at a far greater mass density. It has been found that about one-fifth to one-fifteenth as many tubes are required in the second pass as in the first pass portion. In one embodiment, sufficient refrigerant and cooling flow were realized using 55 tubes in the first pass and 11 tubes in the second pass. In another embodiment, 60 tubes were used in the first pass, and 6 tubes were used in the second pass.

Figure 8:
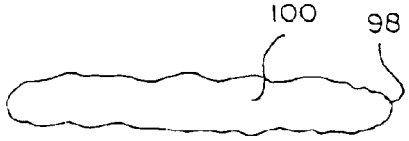
FIG. 8 is an isometric view of a desiccant dryer used in the downflow condenser.

There are many features that may be used in the downflow condenser. A dryer portion may be added. The function of the dryer or desiccant is to absorb moisture from the refrigerant so that excess moisture does not cause problems downstream, such as clogging or freezing in a TXV or other expansion device. Such a dryer is depicted in FIG. 8 as a desiccant bag 98 with desiccant 100 suitable for absorbing moisture from the refrigerant. Desiccant bag 98 is inserted into port 96 of the far portion of the lower manifold. The condenser is operating on the high side of the refrigerant system, that is, with pressures generally in the range of 150 to 450 psig, 1.0–3.1 MPa. Therefore, any connections used for the downflow condenser, such as refrigerant in or out, desiccant cartridges, temperature probes, pressure gauges, and the like, must be suitable for such service.

Another technique known to improve the utility and efficiency of heat exchangers generally, and condensers in particular, is the use of extended surfaces on the outside of tubes. Such extended surfaces, normally fins, first conduct the heat from the tube, and then convect heat into a passing air stream, such as that provided by a moving vehicle or refrigeration system whose condenser has access to the airstream. The fins may be of any shape or size, and may be of any material suitable for the application. In practice, metallic tubes and fins, such as those made from aluminum, are most often used because of their availability and economy, good heat conduction properties, and light weight. The fins may be arranged in discrete patterns, or the fins may be affixed to each tube as a whole, typically in a serpentine pattern. Condenser tubes provide as many fins as possible without reducing the projected free area of the tubes into the cooling air, that is, without blocking the airflow that convects away the heat.

Figure 9:
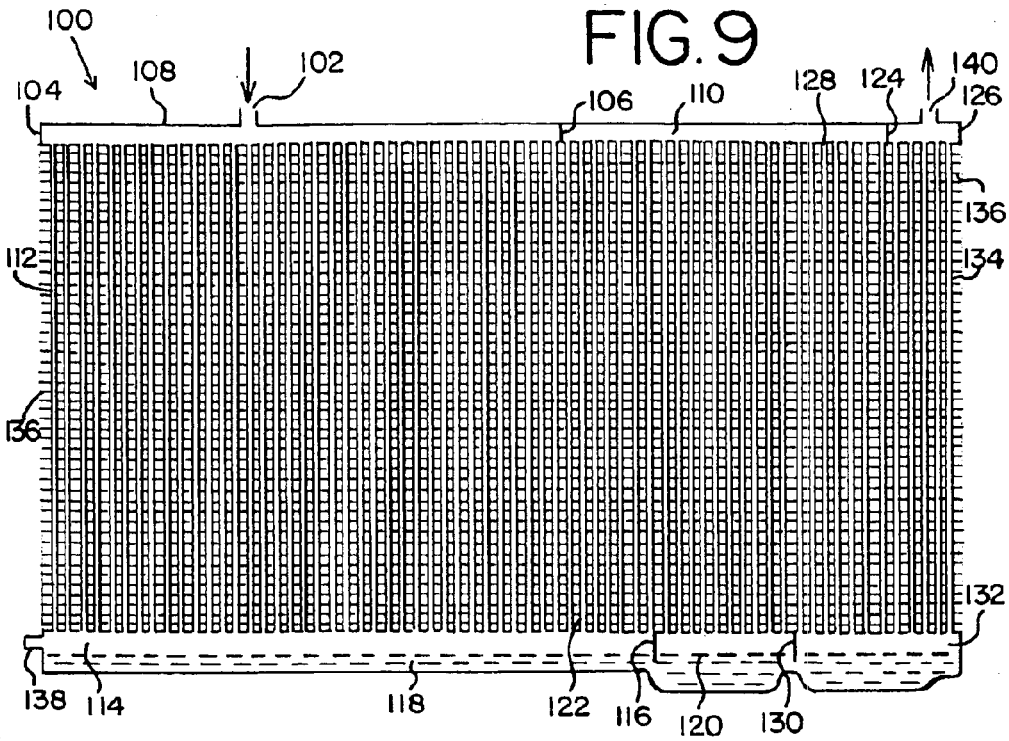
FIG. 9 is a side view of a four-pass downflow condenser with a partial cross-section of the bypass baffles.

In addition to a two-pass downflow condenser, condensers of more than two passes may be constructed and advantageously used. FIG. 9 depicts a four-pass downflow condenser 100. Note that the four passes are all in a vertical relationship with the tubes being vertically aligned between a manifold on top and a manifold on bottom, whether the refrigerant is flowing from bottom to top or top to bottom. The flow is vertical, and each pass is vertical, with a header or manifold being higher than the tubes which are higher than the other header or manifold.

Hot, compressed refrigerant enters the condenser 100 through an inlet 102 at the top of the condenser. Inlet 102 is part of an upper manifold 104, which is divided by baffle 106 into a near portion 108 and a middle portion 110. The baffle is impermeable and allows essentially no flow of refrigerant from the near portion to the middle portion through the baffle. At least one first heat exchange tube 112 is connected from the near end of the upper manifold to a lower manifold 114. One or more than one heat exchange tubes are used to channel the flow of refrigerant from the upper manifold to the lower. Lower manifold 114 is divided by a first lower baffle 116 into a near portion 118 and a middle portion 120.

In the four pass downflow condenser, the hot, gaseous refrigerant flows into the inlet, as discussed, and down through at least one first heat exchange tube, wherein at least a portion of the refrigerant is condensed and remains in the lower manifold. Upon reaching the lower manifold, a combined liquid-gas flow continues upward into a second pass of the downflow condenser. The first pass is considered the near-portion of the downflow condenser, numerals 108, first heat exchange tube or tubes 112, and the near portion 118 of the lower manifold.

On the near side of the first lower baffle, at least one second heat-exchange tube 122 is connected between the near portion 118 of lower manifold 114 and the middle portion 110 of upper manifold 104. Typically, more than one second tube 122 is used. A mixture of gaseous and liquefied refrigerant passes through the at least one second heat-exchange tube 122, into the middle portion 110 of the upper manifold 104. During the upward flow, refrigerant that condenses may form a film on the inner walls of tubes 122 and may fall below into lower manifold near portion 118, or may be entrained along with gaseous flow into the middle portion of the upper manifold. In the upper manifold, a second baffle 124 forms an impermeable barrier and creates a far portion 126 of the upper manifold. Third heat-exchange tubes 128 connect between the middle portion 110 of the upper manifold and the middle portion 120 of the lower manifold. The second pass of the downflow condenser is the near portion of the lower manifold, the one or more second heat-exchange tubes, and the middle portion of the upper manifold. This second pass may include both liquid and gaseous flow upward. The third pass of the downflow condenser is a downward pass between the middle portion of the upper manifold, one or more third heat-exchange tubes, and the middle portion of the lower manifold. This pass will also see two-phase flow, with gaseous refrigerant entering from the top manifold; the goal of this stage is to pass only liquid refrigerant to the fourth pass.

A second lower baffle 130 creates the fourth pass in the lower manifold, forming a far portion 132 of the lower manifold. Fourth heat-exchange tubes 134 pass between the far portion of the lower manifold to the far portion 126 of the upper manifold, and desirably contain only liquid refrigerant flow, subcooling the condensed refrigerant on its final pass through the condenser. Fins 136 may be used on any of the tubes of the downflow condenser. Also shown in FIG. 9 is port 138 for a dryer useful for providing desiccant in a downflow condenser. Subcooled, liquid refrigerant leaves the condenser via outlet 140.

The baffles of the upper manifold are impermeable, consistent with good manufacturing practice, in that essentially no flow allowed through the baffle. The baffles of the lower manifold, however, are designed to allow liquid to flow from the near portion to the middle portion, and from the middle portion to the far portion, so that entrainment of liquid into the second and third passes of the condenser are minimized. Because of the many variables possible in the design of a downflow condenser, one cannot state a particular size of leak path for the lower baffle, or set a particular size of flow aperture in a lower baffle using a depressed manifold type of arrangement. The sizes of the baffles are completely dependent on the flow of refrigerant, the load on the refrigerant system, the heat exchange capacity of the downflow condenser, the cooling rate available to the condenser, and all the variables well known to those in the heat exchange arts. In one embodiment of a vehicle air-conditioner, refrigerant flow may vary from 2 to 10 kg per minute (3 to 22 lbs. per minute). It is clear that the goal of the four-pass downflow condenser design, however, is to minimize the flow of liquid refrigerant that passes to the second pass, and it is the further goal to pass no gaseous refrigerant to the fourth pass.

In one embodiment in a two-pass downflow condenser, a lower manifold of about 20 mm diameter was used, and a bypass baffle used had areas equivalent to holes about 7 to 10 mm diameter. The entire "hole" or leak area is taken at the bottom of the baffle, as shown in FIG. 5. The portion of leak path may vary from about 15% to about 25% of the cross-sectional area of the lower manifold. In another embodiment using a depressed manifold, the equivalent flow path is created by erecting a baffle in the manifold followed by a depressed or enlarged manifold area downstream of the baffle. In this arrangement, the increase in cross-sectional area of the lower manifold may also vary from about 15% to about 30%. In one embodiment, a lower manifold having a diameter of about 20 mm had a useful increase in diameter from about 21.5 mm to about 23 mm in the depressed area downstream of the baffle.

In one embodiment, first, second, third and fourth heat-exchange tubes of equal cross-section were used, and comprised 30, 15, 5 and 16 tubes respectively. The tubes used provide relatively high resistance to flow of refrigerant, consistent with high-side pressure being available. In one embodiment, tubes of an oval shape and made of aluminum were used. The tubes had a major diameter of about 16 mm and a minor diameter of about 1.8 mm, and were about 450 mm long, from upper manifold to lower manifold. Because the tubes are relatively thin and flat, they create conditions for a high-resistance, high-velocity flow of gaseous refrigerant, and they also create conditions for maximal contact between the refrigerant and the walls of the tubes, allowing for condensation in as short a period of time as possible. Using oval-shaped tubes, as well as the fins described above, it is possible to achieve projected free areas of 85% and higher into the airstream cooling the condenser. This area is the percentage of external surface area of the tube that the cooling medium can impinge upon, or "see." This area is reduced by the contact area used up by the fins, or any other device interfering with direct heat transfer into the airstream.

Figure 10A:
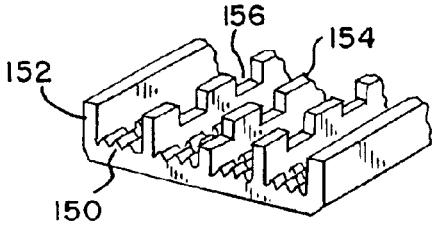
FIGS. 10*a,* 10*b,* and 10*c* are depictions of a nondiscrete refrigerant tube useful in the present invention.
Figure 10C:
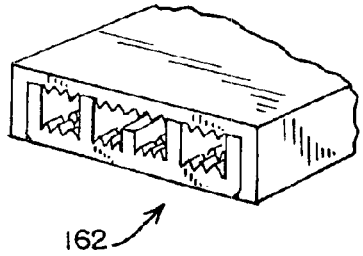
Figure 10B:
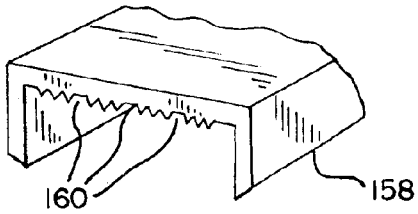

In addition to using a number of tubes for any pass of a four-pass downflow condenser, a nondiscrete refrigerant tube (NRT) may be used. A NRT is depicted in FIGS. 10*a*. 10*b* and 10*c*. FIG. 10*a* depicts that the NRT may be formed of a main body 150 having side walls 152 and internal partition walls 154. The partition walls are not solid, but include openings 156, allowing communication and flow from partition to partition, and hence the name of "nondiscrete" tubes. FIG. 10*b* depicts a top portion 158 or "lid" for the NRT, including one or more channels 160 built in for fitting with the partition walls of the main body. The main body and the top portion are manufactured, typically by forming or machining, and are then assembled as shown in FIG. 10*c*, into a nondiscrete refrigerant tube (NRT) 162.

A number of configurations of downflow condensers have been constructed and tested. The test results of graphed according to the Coefficient of Performance, refrigerant ($COP_r$). The $COP_r$ is a numerical result formed by taking the cooling provided by the evaporator and dividing it by the input power. The evaporator cooling is that typically provided to passengers in a motor vehicle. In other applications, it could be the cooling power provided to a cargo, such as a refrigerated load. The highest coefficient of performance is most desirable.

Figure 11:
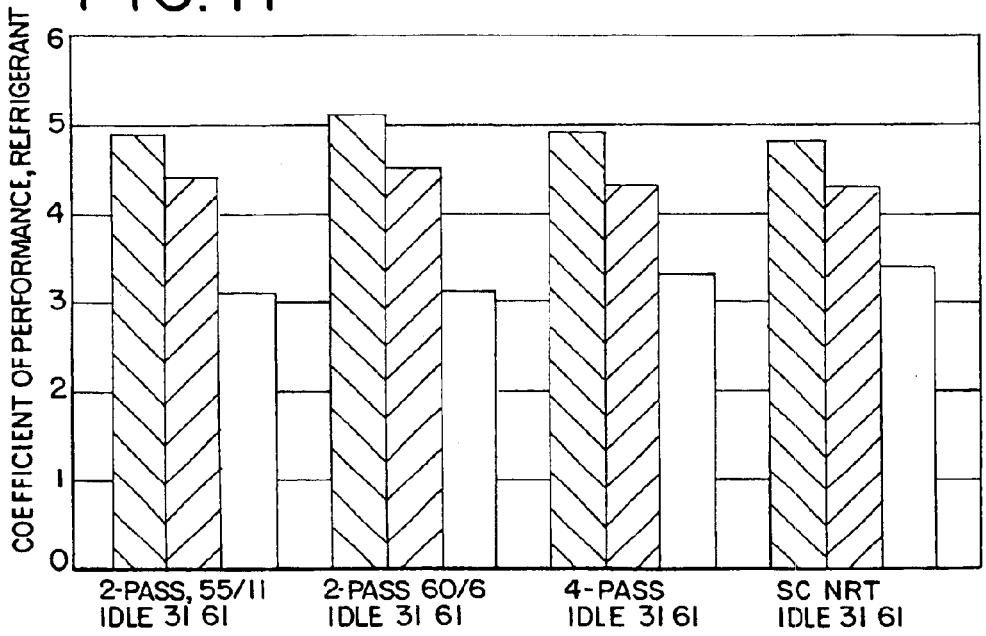
FIGS. 11 and 12 are graphs of performance of downflow condensers according to the present invention.
Figure 12:
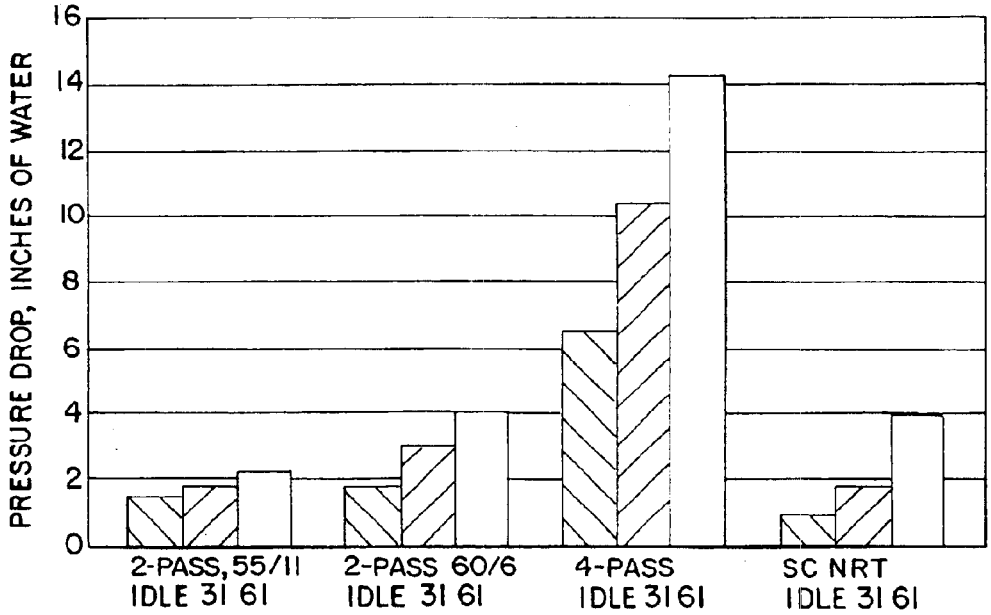

FIG. 11 depicts the performance of downflow condensers in several configurations, based on their performance in a bench test, at simulated speeds of idle, 31 mph, and 62 mph (idle, 50 kph, and 100 kph). The best performance was achieved in these conditions in a two-pass downflow condenser using 60 tubes on the first pass and 6 tubes on the second pass. FIG. 12 depicts one aspect of performance of the downflow condensers, the pressure drop across the condenser. The greater the pressure drop, the more work that must be supplied by a compressor, such as one shown in FIG. 1. In the tests depicted in FIG. 12, the four-pass condenser had much higher pressure drop than the two-pass downflow condensers or the SC NRT (subcooled NRT crossflow control reference). This suggests that the bypass baffles are restricting flow to an extent that is more than desirable, and that the bypass areas should be increased.

Another way to practice the invention in a four-pass downflow condenser is to use the high-resistance NRT tubes described above in a first pass and to use discrete tubes in the second pass. Two-phase flow is expected in the second pass, and refrigerant will condense on its pass upwards through the discrete tubes. The discrete tubes will offer lower pressure drop and will also be highly resistant to stalling, that is, the situation where one or more tubes will fill with liquid, blocking the upwards flow of gas.

It is desirable, whether using discrete tubes or an NRT, to avoid splashing as the refrigerant falls into the lower manifold. Splashing may create waves in the bottom manifold, allowing gas to bypass the baffle, and venting unwanted pressure and vapor to stages downstream of the condensation stages, typically the first pass in a two-pass downflow condenser, and the first two passes in a four-pass downflow condenser. As long as the trough of the waves does not allow gas to bypass the baffle, the condenser will not be adversely affected.

There are also other ways to practice the invention. For example, a dryer need not be incorporated into the condenser, but rather may be detailed to an additional housing or vessel external to the condenser. While condensers of 2 and 4 passes have been described, other condensers of 3, 5, 6 or additional passes may also be used, so long as the principles of early, downward condensation and separation of liquid from gaseous refrigerant are followed. While manifolds and heat-transfer tubes of aluminum are described, the invention will work as well with other materials, consistent with their thermal conductivity properties. A dryer or desiccant bag has been depicted inside the lower manifold, but a dryer would work as well inside the upper manifold.

It is therefore intended that the foregoing description illustrates rather than limits this invention, and that it is the following claims, including all equivalents, which define this invention. Of course, it should be understood that a wide range of changes and modifications may be made to the embodiments described above. Accordingly, it is the intention of the applicants to protect all variations and modifications within the valid scope of the present invention. It is intended that the invention be defined by the following claims, including all equivalents.

What is claimed is:

1. A downflow condenser, comprising:

an upper horizontal manifold having a near end and a far end, separated by an impermeable upper baffle, an inlet connected to the near end of the upper horizontal manifold and an outlet connected to the far end of the upper horizontal manifold;

at least one first tube having a first end and a second end, connected at the first end to the near end of the upper manifold;

a lower horizontal manifold having an inner surface, a near end and a far end, the lower manifold defining a liquid communication path extending the entire length of the lower manifold, the lower manifold being connected at the near end to the first end of at least one tube that is connected at the second end to the near end of the upper horizontal manifold, wherein the near end of the upper manifold, the at least one first tube and the near end of the lower manifold are in a vertical relationship, and comprise a first pass;

a partial lower baffle in the lower manifold, separating the near end and the far end of the lower manifold, the partial lower baffle is secured to the lower manifold along the top and two sides and sized to create a gap between the bottom of the partial lower baffle and the inner surface of the lower horizontal manifold, defining a liquid only passageway that only allows liquid to enter the second pass;

at least one second tube having a first end connected to the far end of the lower manifold, and a second end connected to the far end of the upper manifold, wherein the lower manifold, the at least one second tube and the upper manifold are in a vertical relationship, and the far end of the lower manifold, the at least one second tube and the far end of the upper manifold comprise a second pass, the upper manifold being oriented relative to the lower manifold such that fluid entering the upper manifold and the at least one first tube cools and condenses and flows by gravity into the lower manifold, and the liquid enters the second pass and leaves through the far end of the upper manifold.

2. The condenser of claim 1, further comprising a dryer inside the condenser.

3. The condenser of claim 1, further comprising extended surfaces on the exterior of a tube selected from the group consisting of the at least one first tube and the at least one second tube.

4. The condenser of claim 1, wherein a nondiscrete refrigerant tube (NRT) comprises at least one pass of the condenser.

* * * * *